United States Patent [19]

Hurko

[11] Patent Number: 4,808,793

[45] Date of Patent: Feb. 28, 1989

[54] TANKLESS ELECTRIC WATER HEATER WITH INSTANTANEOUS HOT WATER OUTPUT

[75] Inventor: Bohdan Hurko, Louisville, Ky.

[73] Assignee: EverHot Corporation, Indianapolis, Ind.

[21] Appl. No.: 929,896

[22] Filed: Nov. 13, 1986

[51] Int. Cl.[4] ..... H05B 1/02; H05B 3/82; F24H 1/10

[52] U.S. Cl. ..... 219/306; 219/298; 219/308; 219/309; 219/330

[58] Field of Search ..... 219/296–299, 219/301–309, 320–321, 328–331

[56] References Cited

U.S. PATENT DOCUMENTS

| | | | |
|---|---|---|---|
| 1,805,885 | 5/1931 | Rinderspacher et al. | 219/306 |
| 1,965,218 | 7/1934 | Carr | 219/289 X |
| 2,825,791 | 3/1958 | Jackson | 219/321 X |
| 2,866,884 | 12/1958 | Minier . | |
| 3,952,182 | 4/1976 | Flanders | 219/309 |
| 3,968,346 | 7/1976 | Cooksley | 219/305 |
| 3,969,605 | 7/1976 | Danell | 219/208 |
| 4,085,308 | 4/1978 | Youngquist | 219/309 |
| 4,218,607 | 8/1980 | Noland | 219/301 |
| 4,395,618 | 8/1983 | Cunningham | 219/298 |
| 4,436,983 | 3/1984 | Solobay | 219/321 X |
| 4,459,465 | 7/1984 | Knight | 219/309 |
| 4,604,515 | 8/1986 | Davidson | 219/306 X |

*Primary Examiner*—Anthony Bartis
*Attorney, Agent, or Firm*—Scott R. Cox

[57] ABSTRACT

A tankless electric water heater having instantaneous hot water output includes an open-ended folded tubular conduit having a separate metal-sheathed immersion heating element inserted in to each end of the conduit and carried by a cap member sealing the open end. Each cap member carries a thermostat having a preset temperature of about 140° F. and connected in series with the heating element carried by the respective cap member. A self-regulating PTC heating cable, either disposed in or wrapped around the tubular conduit, is continuously energized independently of the metal-sheathed heating elements to maintain the water in the tubular conduit a constant temperature of about 150° C. during standby periods. A water inlet conduit connected to one cap member is provides with a water flow responsive switch connected in series with the thermostastic for energizing the metal-sheathed heating elements upon demand for hot water flow and hot water is discharged through an outlet conduit connected to the other cap member.

13 Claims, 3 Drawing Sheets

FIG. 4
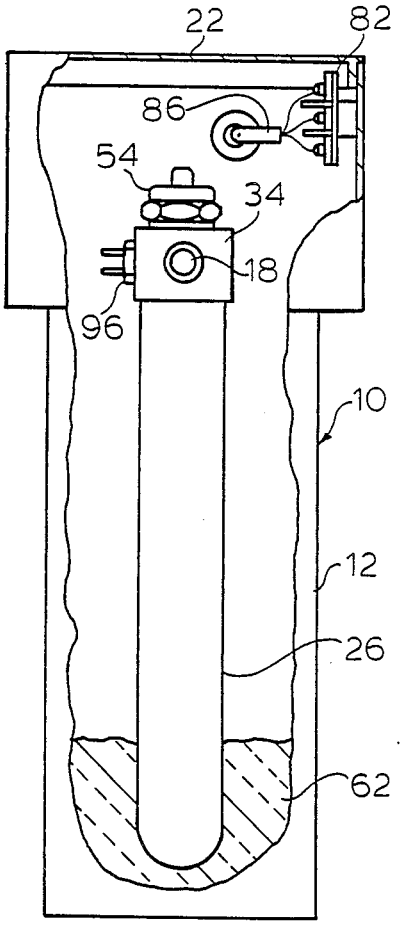
FIG. 2
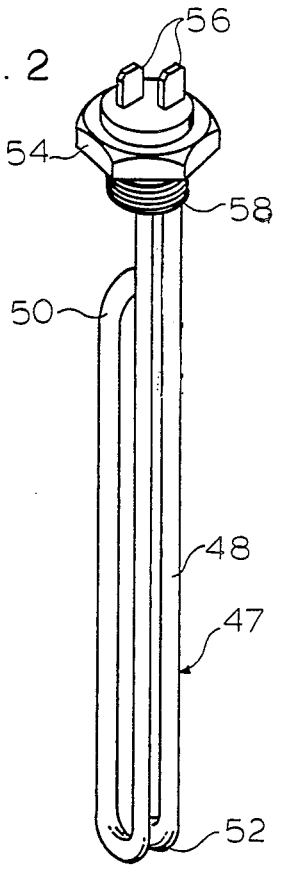
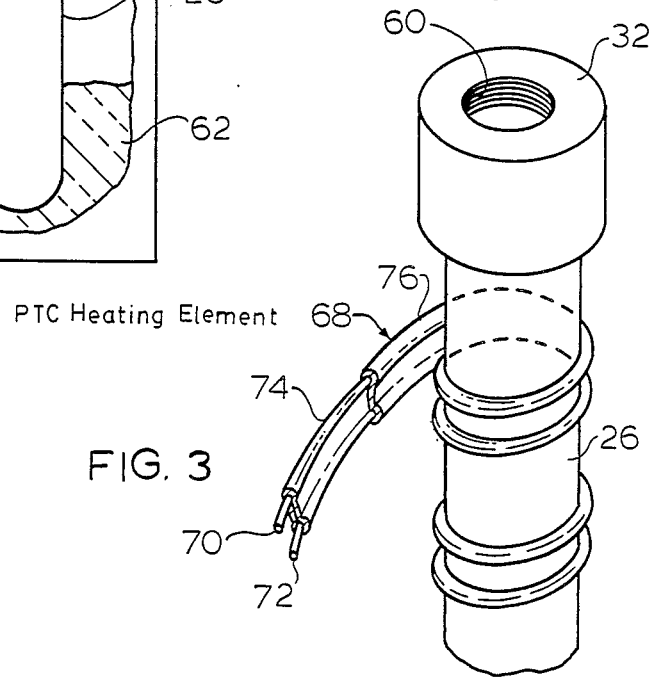
FIG. 3

TANKLESS ELECTRIC WATER HEATER WITH INSTANTANEOUS HOT WATER OUTPUT

BACKGROUND OF THE INVENTION

1. Field of the Invention

This invention relates to the art of instantaneous tankless water heaters of the general type for domestic use in the home and, especially, for living areas having small kitchens, house trailers, campers, and mobile homes. This invention relates to automatic, electric, in-line water heaters, for the water to be heated is brought into heatabsorbing relation to one or more electrical resistance heating elements and are automatically energized when the water begins to flow.

2. Description of the Prior Art

The Cooksley U.S. Pat. No. 3,968,346 describes a method and apparatus for electrically heating water. This is a compact design having a fast-acting, tankless heater with an elongated tubular casing having the cold water inlet at one side and the hot water and steam outlet at the opposite side. This water heater has two electric heaters, where one may be a rubberized, flexible, heating mat which is surrounded by a thick body of thermal insulation.

The Dannell U.S. Pat. No. 3,969,605 describes a thermal pulse-type heater which is installed within a coolant hose of a liquid-cooled automobile engine. This type of invention is to be used in extremely cold climates for assisting in starting the car early in the morning when the ambient temperature is below zero.

The Youngquist U.S. Pat. No. 4,085,308 describes an electric water heater for use with bathroom showers. Various provisions protect this heater from overheating and burnout under all operating conditions.

The Minier U.S. Pat. No. 2,866,884 relates to electric heaters for bathroom showers. There is a built-in switch control having a manually operated switch button for energizing the heater and a bimetallic switch mechanism serving as an over-temperature protection to deenergize the circuit once the water flow is stopped.

The Rinderspacher et al U.S. Pat. No. 1,805,885 describes a cylindrical hosing having concentric tubes with an electric resistance heater interposed therebetween. The water is compelled to flow in close proximity to the walls of the heating tubes for exchanging the heat from the heater to the water.

The Noland U.S. Pat. No. 4,218,607 describes a water-circulating device for an animal watering apparatus having three nipple valves attached to the water supply tube. There is a heating element that passes in close proximity to the water supply pipe. This design serves to provide an economical mechanism for keeping the animal watering device from freezing in cold weather.

The Cunningham U.S. Pat. No. 4,395,618 describes an electric circulation heater for heating fluid such as oil. There is an imperforate, heavy-duty, steel tubular body closed at both ends and having internal vanes establishing a plurality of separated, longitudinally-extending, chambers therein. The vanes are ported to establish a fluid flow path serially through the chambers. A plurality of metal-sheathed electric heating elements are located within the chambers.

The Knight U.S. Pat. No. 4,459,465 describes an instantaneous fluid heater having a combined safety shutoff and temperature regulator including a hollow heater block with a fluid inlet, a fluid outlet, and inner walls defining a plurality of interconnected heating chambers forming a serpentine fluid flow path from the inlet to the outlet. An electrical sequence switching arrangement cooperates with a plurality of thermostats to sequentially energize the heating elements, beginning with the heating element in the most downstream chamber. The fluid heater includes a flow switch for allowing operation only in response to a minimum fluid flow rate. A safety thermostat is provided at the downstream end of the most downstream chamber to establish a maximum permitted fluid temperature.

OBJECTS OF THE PRESENT INVENTION

The principal object of the present invention is to provide a tankless water heater having electrical heating means as well as a supplementary, self-regulating, heating cable that is energized at all times for maintaining the water temperature within the unit at about 150° F.

A further object of the present invention is to provide a tankless water heater of the class described where the supplementary heating cable has an electrical resistance that increases, as the temperature of the water increases so that the heat output does not exceed a level that is just enough to replenish the heat losses so that the water heater will always supply hot water when water is drawn from the water outlet conduit.

A further object of the present invention is to provide a tankless hot water heater of the class described having at least two, metal-sheathed, electrical resistance heating elements inserted into each end of a tubular conduit respectively, where there is a normally-open thermostat associated with each whereby the heating element nearest the water inlet will be energized first, and there is a time delay between the energization of the first heating element relative to the energization of the second heating element.

SUMMARY OF THE INVENTION

The present invention provides a tankless water heater having instantaneous hot water output, and it includes a folded tubular conduit having a least two, metal-sheathed, electrical resistance heating elements inserted into each end of the tubular conduit respectively. A cap member is sealed to each end of the tubular conduit, and it serves as a mounting means for the heating element. A temperature-sensing thermostat is mounted in each cap member so as to be normally open. There is a third, self-regulating (PTC), heating cable associated with the folded tubular conduit for maintaining the water temperature within the conduit at a predetermined temperature of about 150° F. This third heating cable has a novel resistance characteristic that increases when the temperature of the element increases, so that the heat output does not exceed a level that is just enough to replenish the heat losses from the tubular conduit.

BRIEF DESCRIPTION OF THE DRAWINGS

This invention will be better understood from the following description taken in conjunction with the accompanying drawings, and its scope will be pointed out in the appended claims.

FIG. 2 is a perspective elevational view of one of the metal-sheathed electrical resistance heating elements of double-looped construction.

FIG. 3 is a fragmentary perspective view of a short length of one leg of the copper tubing in which the metal-sheathed heating element is inserted, where the tubing is wound on its outside with a length of self-regulating heating cable which serves to maintain the water temperature within the conduit at a predetermined temperature during periods of no-flow through the water heater.

FIG. 4 is right side elevational view of the tankless hot water heater shown in FIG. 1 with parts broken away and others in cross section to show one side of the U-shaped loop of copper tubing having supported therein a metal-sheathed electrical resistance heating element.

DESCRIPTION OF THE PREFERRED EMBODIMENT

Figure 1:
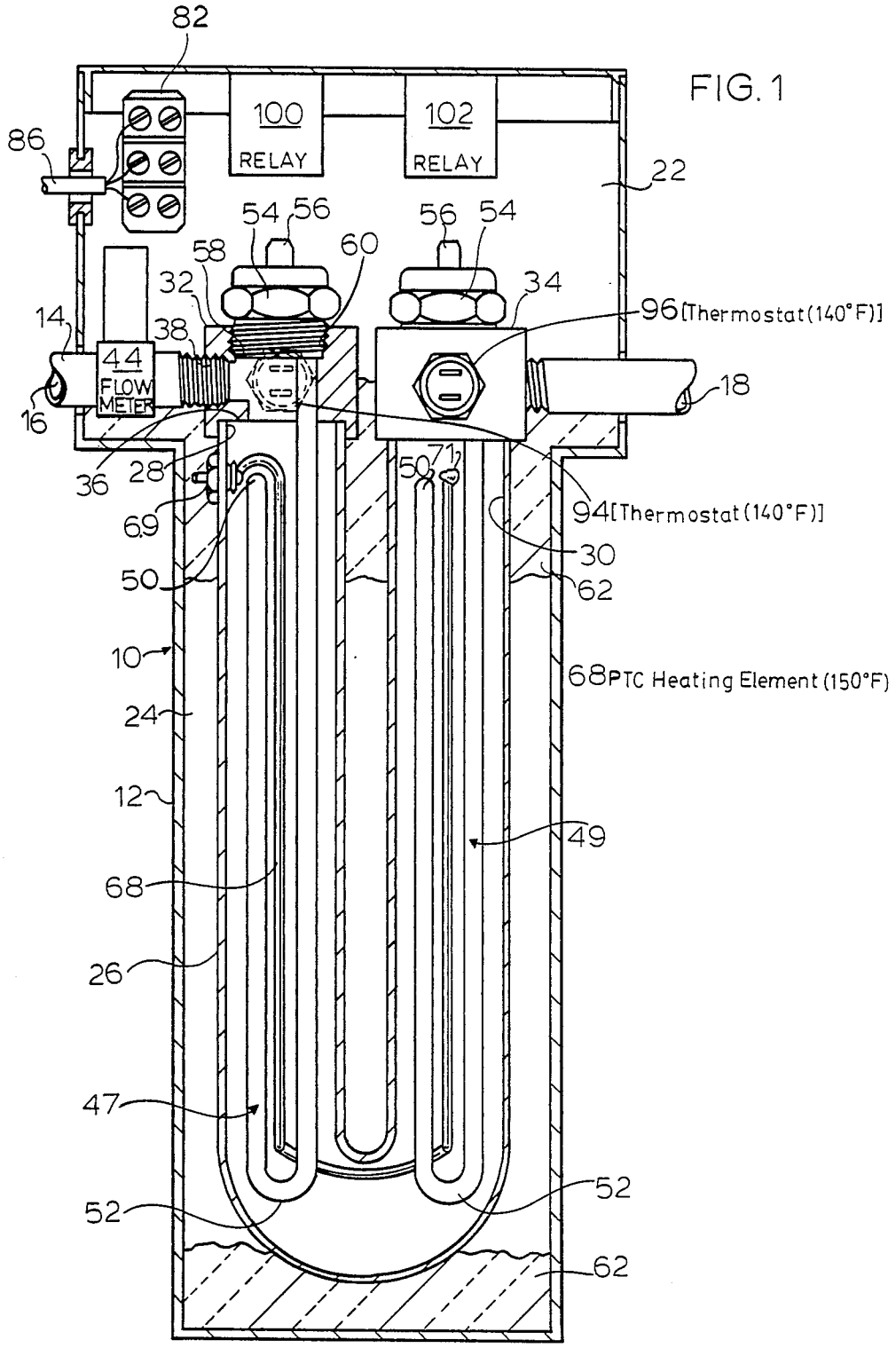
FIG. 1 is a front elevational view of the tankless hot water heater embodying the present invention with parts broken away at the front to show various components in cross section including a U-shaped copper tubing having a pair of folded metal-sheathed electrical resistance heating elements and a third self-regulating heating cable inserted within the tubing.

Turning now to a consideration of the drawings and, in particular, to the front cross-sectional view of FIG. 1, there is shown a tankless water heater 10 embodying the present invention housed in a metal cabinet 12. This cabinet is intended to be mounted in an upright position on a vertical surface, and interposed in a length of horizontal water pipe 14, where the cold water inlet 16 is at the left side and the hot water outlet 18 is at the right side. The metal cabinet 12 is of compact design, having general overall dimensions of a height of 24 inches by a width of about 9 inches and a depth of about 4 inches. This compact design makes the unit especially attractive for use in small kitchens, mobile homes, trailers, and the like. The unit is also of low weight; being less than 20 pounds. Therefore, it is easy to handle during installation and suitable for shipment in the mails.

The upper end of the cabinet 12 comprises the electrical feed box 22, while the lower main portion of the metal cabinet comprises an insulated housing 24 in which a U-shaped copper tubing 26 is vertically mounted. Fitted to the open upper ends 28 and 30 of the copper tubing 26 is a cap member 32 and 34 respectively. Both cap members 32 and 34 are identical so that only one, 32, will be described in detail. The bottom of the cap member 32 has a circular opening 36, which fits tightly over the top end 28 of the copper tubing and is soldered, or brazed, thereto. A tapped opening 38 is formed in the left side of the cap 32 for receiving the threaded end 40 of the cold water inlet pipe 16. Interposed in this cold water inlet pipe 16 is a water flow meter 44 that responds to a predetermined minimum rate of water flow to activate the electrical circuit to the electrical heaters and to deactivate the heaters whenever the water flow rate falls below the minimum of approximately 0.5 gallons per minute. Metal sheathed electrical resistance heating elements 47 and 40 are each installed respectively in the cap members 32 and 34, and extend longitudinally down into each upright leg of the U-shaped copper tubing 26. The nature of these two heating elements 47 and 49 can best be understood from the perspective vertical view of FIG. 2. It is desirable to have a long length of this heating element so as to obtain the desired wattage of 7200 watts, 240 volts rating, within a compact space. These heaters 47 have a metal sheath 48 that is formed in a close parallel loop having a reentrant end 50 and an intermediate bend 52 so that the heating element is doubled back on itself for nearly its complete length. The upper end of the heating element 47 in FIG. 2 is fitted with a screw fitting 54, which joins the two free ends of the heating element 46 together, and which is provided with electrical terminals 56 for making an electrical connection therewith. The lower end of this screw fitting 54 is provided with external screw threads 58 for insertion into a tapped opening 60 in the top portion of the cap member 32. While the cap member 32 has been shown as a hollow block with tapped openings 38 and 60, it will be understood by those skilled in this art that the cap member could have been formed as a T-shaped tubular copper fitting having slip-fit connections with the top end of the copper tubing, with the cold water inlet pipe 16 and with the fitting 54 that serves as the mounting means for the metal-sheathed electrical resistance heating elements 47 or 49. The heating element nearest the cold water inlet 16 is element 47, and the heating element nearest the hot water outlet 18 is element 49.

The amount of water retained within the U-shaped copper tubing 26 and the two cap members 32 and 34 and the adjacent connections with the cold water inlet pipe 16 and the hot water outlet pipe 18 is very low; on the order of 0.3 gallons. Also, the surface area of the heater tubing is only about 1.3 sq. ft., so that the heat losses will only be a fraction of the heat losses of a conventional 30 gallon, tank type water heater. A blanket of thermal insulating material 62 is placed around the U-shaped copper tubing 26 for retaining much of the heat generated within the tubing rather than having it dissipated into the room in which the water heater is mounted.

Figure 6:
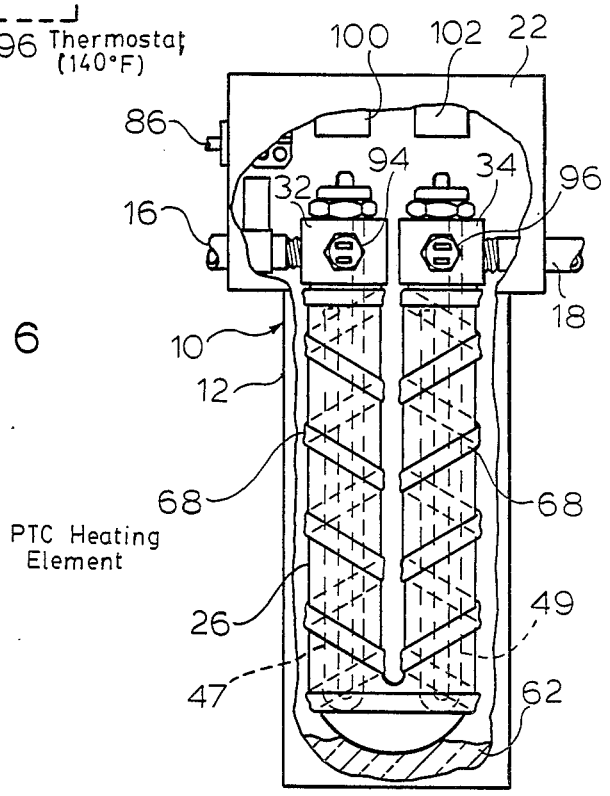
FIG. 6 is a front elevational view, on a reduced scale, of a second modification of the present invention, where the self-regulating heating cable is would around the outside of the U-shaped tubing, as shown earlier in FIG. 3.

A third heater 68 is associated with the two metal-sheathed heaters 47 and 49, and this third heater is in the form of a flexible self-regulating heating cable of the type that is wound around water pipe to prevent water pipe freeze-ups in the home. The nature of this heating cable 68 is best shown in FIGS. 3 and 6 wound around the outside of each vertical stand of the U-shaped copper tubing 26. This external wrap is a second modification of the present invention. The preferred embodiment has this flexible self-regulating heater cable immersed in the water within the U-shaped tubing 26.

This flexible heating cable 68 is of parallel-circuit design having two parallel, stranded, metal conductors 70 and 72, which are separated by a conductive polymer core 74, and then is provided with an overall insulating sheath or jacket 76. The conductive polymer core 74 of this self-regulating PTC heating cable operates as though it contains millions of parallel resistors between the bus wires 70 and 72 in each foot of heater cable. Because of this parallel circuit design, this heating cable can be cut to length without affecting heat output per foot. This heating cable can be looped, spiralled, or crossed over itself without causing burnouts. At low temperatures, electrical current flow through the conductive polymer core 74 between one conductor 70 and the other conductor 72, thereby generating heat. As the temperature rises, the resistance of the core increases, reducing current flow and decreasing the heat output.

One type of this self-regulating heating cable 68 is sold by the Raychem Corporation of Menlow Park, Calif. This action of the self-regulating heating cable 68 is completely reversible. A drop in the surrounding temperature causes the heating cable to lose heat more rapidly, thus lowering the temperature of the heater core 74. This decreases the resistance of the core, allowing a higher current flow and, therefore, the generation of more power. Power output is determined independently by the localized temperature at every point along the length of the heating cable 68. This greatly reduces the need for external controls while it provides safe, reliable, and uniform heat.

This self-regulating heating cable 68 is always energized, and it is designed to keep the water within the water heater at a certain predetermined temperature level; for instance, at 150° F. As the water temperature reaches this 150° F. level, the resistance of the heating cable 68 increases, and the heat output drops to the level just enough to replenish the heat losses from the U-shaped copper tubing 26 so as to maintain the water temperature within the water heater at 150° F. so that the water heater will always supply hot water when hot water is drawn from the hot water outlet pipe 18.

As seen in FIG. 1, the third, self-regulating heater 68 is brought into the U-shaped copper tubing 26 by means of a terminal fitting 69 extending through the upper end of the sidewall of the left hand portion of the tubing 26. This heater 68 extends down through the inlet heater 47, and then up through the outlet heater 49. The free end of this heater cable 68 is provided with an end seal 71.

Figure 5:
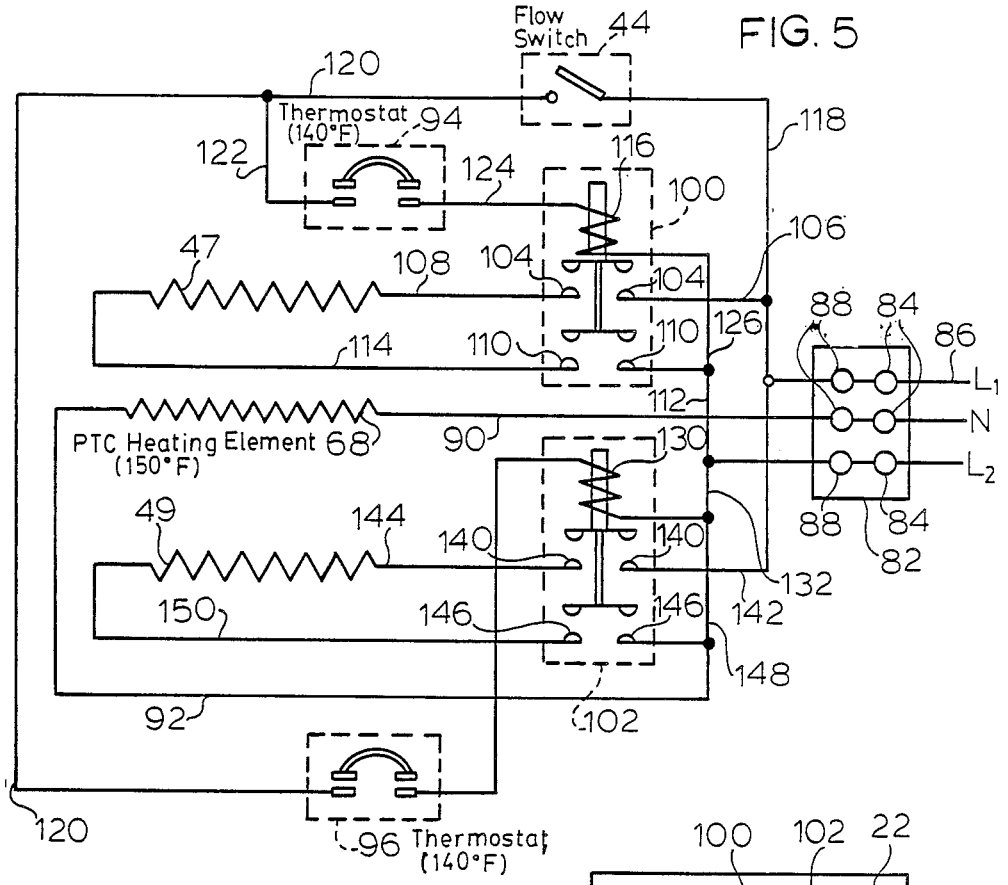
FIG. 5 is a schematic wiring diagram of a preferred embodiment of the present invention.

Reference will now be made to the schematic circuit diagram of FIG. 5 of the present invention. A terminal block 82 has a first set of three terminals 84 for receiving a three-wire, 240 volt, electrical supply cable 86 having lead wires L1 and L2 and a neutral conductor N. The terminal block 82 has a second set of three terminals 88. As stated earlier, the third source of heat, the self-regulating heating cable 68 is always energized, and it is shown connected by lead wires 90 and 92 to two of the terminals 88 connecting between line L 2 and neutral wire N.

As seen in FIG. 1, each cap member 32 and 34 is fitted with a temperature sensing thermostat 94 and 96, respectively. Thermostat 94 is the inlet thermostat that is normally open and is set to close at a predetermined temperature of about 140° F., while the second thermostat 96 is the outlet thermostat, and it is normally set to close at about the same temperature. Interposed between the first, inlet heater 47 and the terminal block 82 is a first relay 100, while interposed between the second, outlet heater 49 and the terminal block 82 is a second relay 102. Each relay 100 and 102 has a rating of 30 amps/240 volts. The first relay has a set of contact 104 that are joined by lead wire 106 to terminal 88 of line L1, and by lead wire 108 to one end of the inlet heater 47. The first relay 100 has a second set of relay contacts 110 that are connected by lead wire 112 to terminal 88 of line L 2, and by a second lead wire 114 to the opposite end of the inlet heater 47 so that this inlet heater 47 will be operating at 240 volts when it is joined in the circuit when the first relay 100 is closed. This first relay 100 that controls the inlet heater 47 is itself controlled by the water flow meter 44 and the inlet thermostat 94 through the relay coil 116, which are all three connected in series. One side of the water flow meter 44 is connected by lead wire 118 to the terminal 88 of line $L_1{}^6$. The other side of the flow meter 44 is connected by lead wire 120 and a second lead wire 122 to one side of the normally-open, cold water inlet thermostat 94. Another lead wire 124 is connected from the thermostat 94 to the relay coil 116, and another lead wire 126 connects from the coil 116 to terminal 88 of the second line $L_2{}^6$.

The hot water outlet thermostat 96 is also connected in series with the water flow meter 44 by means of the lead wire 120 and a second lead wire 128 that connects from the thermostat 96 to the relay coil 130 of the second relay 102. Another lead wire 132 connects the relay coil 130 to the terminal 88 of line $L_2$'.

The second relay 102 has one set of relay contacts 140 that are connected by lead wire 142 to terminal 88 of Line $L_1{}^6$ and connected by a lead wire 144 to one end of the outlet heater 49. A second set of relay contacts 146 are joined by lead wire 148 to terminal 88 of line $L_2{}^6$ and connected by lead wire 150 to the other end of the outlet heater 49.

When the water heater 10 is not being used, the water within the U-shaped copper tubing 26 is heated by the self-regulating heating cable 68 which is always energized and maintains the water temperature at about 150° F. Both of the temperaturesensing thermostats 94 and 96 are normally open, and both metalsheathed heaters 47 and 49 are deenergized. When a hot water faucet (not shown) is opened, and water starts to flow through the water heater 10 at a rate sufficient to energize the water flow meter 44, the first temperature sensing thermostat 94 located at the inlet heater 47 will close because the flow of cold water through the inlet pipe 16 will cool the thermostat 94 below 140° F. This inlet thermostat 94 will close thereby energizing the relay coil 116 which in turn energized the inlet heater 47. At the same time, the second outlet thermostat 96 will remain open for a few seconds because hot water within the U-shaped copper tubing 26 will flow for a short period of time. The outlet thermostat 96 will eventually start to cool down and will close, thereby energizing the relay coil 130 of the second relay 102 which, in turn, energizes the outlet heater 49. For example, if the water flow rate is 3 gallons per minute, the outlet thermostat 96 will close about 10 seconds after the inlet thermostat 94 closes. It is advantageous to have a time delay between the operation of the inlet heater 47 and the outlet heater 49. This time delay limits the electrical current to about 30 amps when the relay contact close and the heaters are energized.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. A tankless water heater having instantaneous hot water output and comprising:

a. an open ended hollow insulated housing fitted with a folded tubular conduit, having a separate metal-sheathed electrical resistance heating element inserted into each end of the tubular conduit, and a cap member sealed to each end of the tubular conduit and serving to mount the first and second heating elements therein;

b. a water inlet conduit joined to a first cap member, and a water outlet conduit joined to the other cap member;

c. a temperature-sensing thermostat mounted in each cap member, and having a preset temperature of about 140° F., and connected in series with the adjacent heating element mounted on the respective cap member, and a water flow meter mounted in the water inlet conduit and in series with each thermostat;

d. a third, continuously energized independently of said metal-sheathed heating elements, self-regulating PTC heating cable in heat exchange relationship with the folded tubular conduit, for maintaining the water temperature therein at a predetermined temperature at about 150° F., whereby the electrical resistance of this heating cable increases as the temperature increases, and the heat output drops to a level that is just enough to replenish the heat losses, and maintain the water within the folded conduit at a temperature of about 150° F., so that the water heater will always supply hot water, when water is caused to flow from the water outlet conduit.

2. The invention as recited in claim 1 wherein the said temperature-sensing thermostat in the first cap member is near the cold water inlet conduit and said water flow meter, and controls the sheathed heating element mounted by said first cap member so that the heating element will become energized when water is caused to flow into the water heater at a rate sufficient to actuate the water flow meter with the flow of incoming cold water tending to cool the first thermostat down below its preset temperature, while the second thermostat in said other cap member remains open, whereby the second sheathed after the first thermostat and the element controlled thereby are energized, dependent upon the flow rate of the water through the water heater.

3. The invention as recited in claim 2 wherein the said self-regulating heating cable is immersed within the water within the folded tubular conduit for nearly the entire length thereof.

4. The invention as recited in claim 3 wherein each sheathed heating element is of hairpin looped design that is, in turn, folded a second time adjacent its middle length back on itself.

5. The invention as recited in claim 2 wherein the said self-regulating heating cable is wrapped around the outside of the folded tubular conduit for nearly the entire length thereof.

6. The invention as recited in claim 1 wherein each of the said temperature-sensing thermostats serve to control electrical energy to the respective adjacent, sheathed heating element dependent upon the water temperature at each thermostat, for closing an electrical circuit to the controlled sheathed heating element when a predetermined low temperature is reached, and for opening the electrical circuit when a predetermined high temperature is reached, and separate electrical switching means cooperating with said thermostats and sheathed heating elements for energizing these sheathed elements, beginning with the heating element nearest the water inlet conduit, there being a time delay between the energization of the heating element nearest the water inlet conduit and the energization of the conduit.

7. The invention as recited in claim 1 with electrical switching means cooperating with said thermostats and said heating elements to separately energize the heating elements beginning with the heating element nearest the water inlet conduit, and said thermostats being arranged in circuit with said heating elements and said electrical switching means to deenergized the respective heating element upon the attainment of said preset temperature.

8. The invention as recited in claim 7 wherein the third heating cable is wrapped around the outside of the folded tubular conduit for nearly the entire length thereof.

9. The invention as recited in claim 8 wherein each sheathed heating element is of hairpin looped design that is, in turn, folded back on itself adjacent its middle length.

10. The invention as recited in claim 9 wherein the folded tubular conduit and the two heating elements within the folded tubular conduit are mounted vertically within the insulated housing, and the water inlet conduit and the water outlet conduit are horizontally aligned with each other, and the two cap members are adjacent the upper end of the folded tubular conduit and electrical switching components are mounted in an upper feed box above the insulated housing.

11. The invention as recited in claim 1 wherein said thermostats each control a separate relay in circuit with a respective heating element.

12. The invention as recited in claim 11 wherein the third self-regulating cable is immersed within the water within the folded tubular conduit for nearly the entire length thereof.

13. A tankless water heater having an instantaneous hot water output and comprising:

a. a hollow insulated housing fitted with a length of open-ended folded tubular conduit with a pair of opposite ends, a separate metal sheathed electrical resistance heating element inserted into each opposite end thereof, and a cap member sealed to each end of the tubular conduit and mounting the sheathed element therein;

b. a water inlet conduit supporting a water flow meter connected to a first cap member and a water outlet conduit joined to the other cap member;

c. a temperature-sensing thermostat mounted in each cap member for controlling electrical current flow to the sheathed element mounted thereby at control temperature around about 140° F.;

d. a self-regulating PTC heating cable continuously energized independently of said sheathed heating elements and disposed in heat exchange relationship with the folded conduit for maintaining the water temperature at a stand-by temperature of about 150° F., the electrical resistance of the heating cable increasing as the temperature, whereby the heat output thereof drops to a level that is just enough to replenish the heat losses from the folded conduit, so that the water heater will always supply hot water when the water is first caused to flow from the water outlet conduit.

* * * * *